US006896194B2

(12) United States Patent
Ricco

(10) Patent No.: US 6,896,194 B2
(45) Date of Patent: May 24, 2005

(54) METHOD OF PRODUCING FUEL INJECTORS, AND RELATIVE FUEL INJECTOR

(75) Inventor: Mario Ricco, Casamassima (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 307 days.

(21) Appl. No.: 10/034,634

(22) Filed: Dec. 28, 2001

(65) Prior Publication Data

US 2002/0130203 A1 Sep. 19, 2002

(30) Foreign Application Priority Data

Jan. 16, 2001 (IT) ..... TO2001A0027

(51) Int. Cl.[7] ..... F02D 7/00
(52) U.S. Cl. ..... 239/5; 239/585.3; 29/407.05
(58) Field of Search ..... 239/5, 584, 585.1–585.5; 123/467, 458; 251/129.14, 129.15, 129.16; 29/407.05, 888.01, 888.06, 888.41, 890.142

(56) References Cited

U.S. PATENT DOCUMENTS 4,946,106 A * 8/1990 Turchi et al. ..... 239/585.3
5,004,015 A 4/1991 Amrhein et al. ..... 137/625.68
5,145,008 A * 9/1992 Yun ..... 141/39
5,154,350 A * 10/1992 Ausiello et al. ..... 239/96
5,246,165 A * 9/1993 De Matthaeis et al. ..... 239/96
5,655,716 A * 8/1997 Mathis ..... 239/533.8
5,971,285 A * 10/1999 Knapp ..... 236/12.2
6,302,087 B1 * 10/2001 Schraudner et al. ..... 123/467
6,443,132 B1 * 9/2002 Ricco et al. ..... 123/467

FOREIGN PATENT DOCUMENTS

| | | |
|---|---|---|
| DE | 1 940 698 | 11/1970 |
| EP | 0 483 770 | 5/1992 |
| WO | 99/37909 | 7/1999 |

OTHER PUBLICATIONS

"O–Ring" 26th Edition Machinery's Handbook, Industrial Press Inc., 2000, pp. 2482–2484.*

* cited by examiner

*Primary Examiner*—Gene Mancene
*Assistant Examiner*—Thach H. Bui
(74) *Attorney, Agent, or Firm*—Ladas & Parry LLP

(57) ABSTRACT

A method of producing fuel injectors for internal combustion engines provides for establishing a working life of each injector conforming with the working life of the internal combustion engine on which it is installed. Each injector has an injector body having a seat; a valve body housed inside the seat so as to form an annular chamber, for receiving high-pressure fuel, and a gap communicating with the annular chamber; and a seal housed inside the annular chamber to seal the gap. The seal is sized as a function of the permanent deformation to which the seal is subjected during use of the injector, so as to achieve a working life of the injector substantially equal to the working life of the engine.

18 Claims, 2 Drawing Sheets

METHOD OF PRODUCING FUEL INJECTORS, AND RELATIVE FUEL INJECTOR

The present invention relates to a fuel injector for an internal combustion engine.

BACKGROUND OF THE INVENTION

A known internal combustion engine fuel injector comprises a tubular injector body extending along a given axis; and a valve housed in a seat in the injector body and comprising a tubular valve body fixed inside the injector body seat and coaxial with the injector body. The injector has an annular chamber defined by the injector body and the valve body, which have respective annular shoulders separated by a given distance equal to the height of the annular chamber.

To form the injector, the valve body is fixed to the injector body in a given position along the axis by means of further shoulders formed on the valve and injector bodies and resting against each other, and by means of a ring nut which engages a threaded portion of the injector body and pushes the valve body axially against the injector body to keep the further shoulders in contact with each other. When connected, the injector body and valve body form, in addition to the annular chamber, a gap communicating with the annular chamber and from which high-pressure fuel may leak. To safeguard against this, the injector comprises a seal housed inside the annular chamber, at said gap, to prevent the high-pressure fuel fed into the annular chamber from leaking between the injector body and the valve body.

The Applicant has found the working life of injectors to vary widely from one injector to another, and at times to differ considerably from the working life of the engine on which they are installed.

SUMMARY OF THE INVENTION

It is an object of the present invention to provide a method of producing injectors with a working life as close as possible to that of the internal combustion engine on which they are installed.

According to the present invention, there is provided a method of producing fuel injectors for internal combustion engines, each injector comprising an injector body having a seat; a valve body housed inside said seat so as to form an annular chamber, for receiving high-pressure fuel, and a gap communicating with said annular chamber; and a seal for sealing said gap; the method being characterized by sizing said seal as a function of the deformation to which said seal is subjected during use of said injector, so as to achieve a predetermined working life of said injector.

The present invention also relates to an injector.

According to the present invention, there is provided a fuel injector for an internal combustion engine, the injector comprising an injector body having a seat; a valve body housed inside said seat so as to form an annular chamber, for receiving high-pressure fuel, and a gap communicating with said annular chamber; and a seal for sealing said gap; the injector being characterized in that said seal is sized as a function of the deformation to which said seal is subjected during use of said injector, so as to obtain a predetermined working life of said injector.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
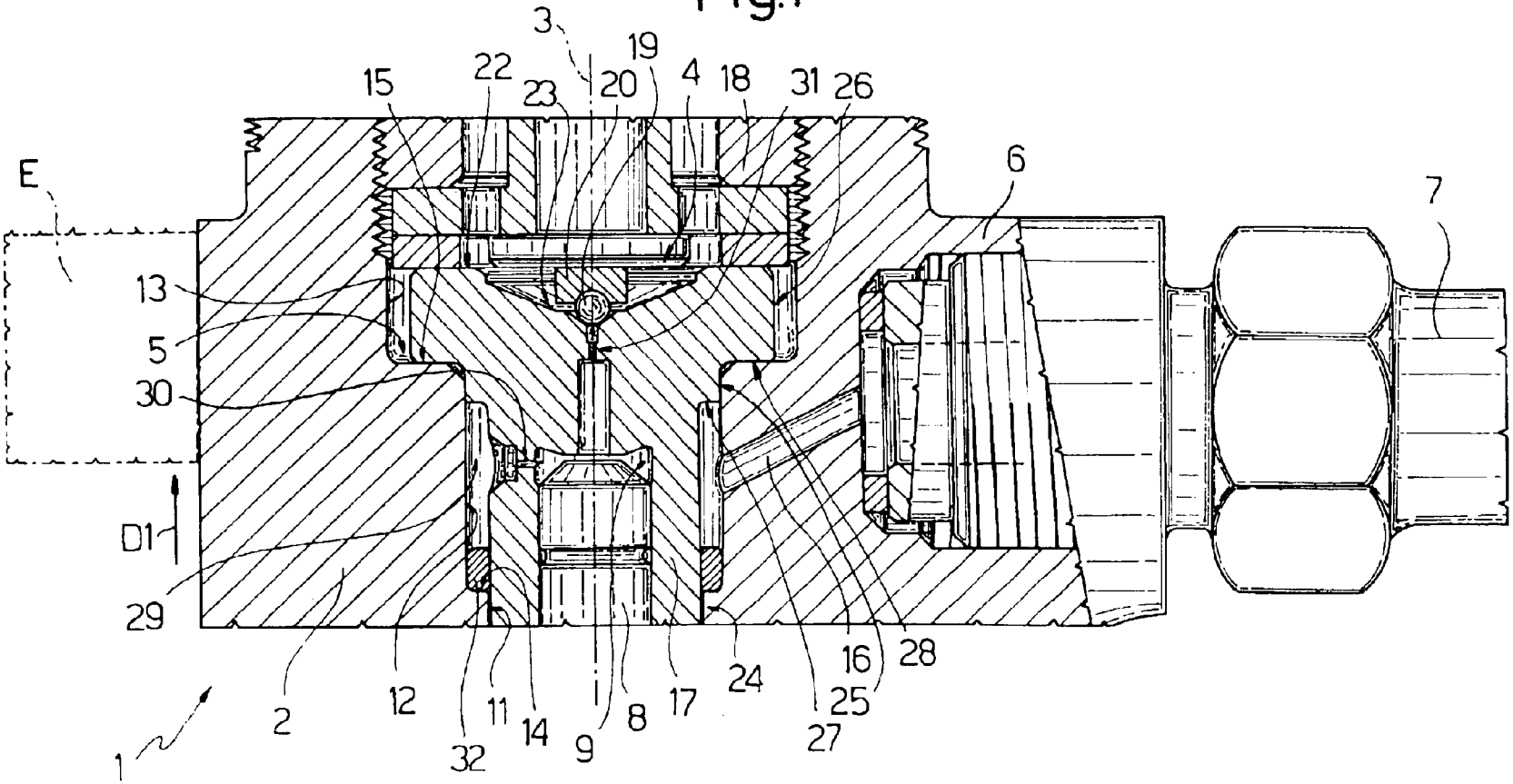
FIG. 1 shows a section, with parts removed for clarity, of an injector produced using the method according to the present invention.

Number 1 in FIG. 1 indicates as a whole a fuel injector for an internal combustion engine E shown schematically by the dash line in FIG. 1.

Injector 1 comprises a tubular injector body 2 extending along an axis 3; a valve 4 housed inside a seat 5 in injector body 2; a fitting 6 for connecting injector 1 to a supply conduit 7 supplying fuel at over a thousand-bar pressure; and a rod 8 housed partly inside a seat 9 in valve 4 and movable in a direction D1 parallel to axis 3.

Hereinafter, both the axis of injector 2 and the axis of injector 1, being coincident, are referred to as axis 3.

Injector body 2 comprises a substantially cylindrical lateral wall 10 in which is formed seat 5, which is defined, parallel to axis 3, by three cylindrical faces 11, 12, 13 having respective diameters increasing upwards in FIG. 1. Face 11 is connected to face 12 by a shoulder 14 perpendicular to axis 3; face 12 is connected to face 13 by a shoulder 15; and, at face 12, a hole 16 extends through lateral wall 10 of injector 2 to connect seat 5 to supply conduit 7.

Valve 4 comprises a valve body 17 housed inside seat 5 and fixed to injector body 2 by a ring nut 18 which pushes body 17 against shoulder 15 of injector body 2; and a shutter 19 which is pressed against valve body 17 by a member 20 and a spring not shown.

Valve body 17 comprises an annular end face 22 perpendicular to axis 3 and defining, internally, a truncated-cone-shaped seat 23 for shutter 19; and three cylindrical faces 24, 25, 26 extending about axis 3 and having respective diameters increasing upwards in FIG. 1. Face 24 is connected to face 25 by a shoulder 27 perpendicular to axis 3; face 25 is connected to face 26 by a shoulder 28; and, once valve body 17 is fitted inside seat 5 in injector body 2, shoulder 28 rests on shoulder 15, and valve body 17 is maintained in this position by ring nut 18.

Shoulder 27 is maintained at a given distance of other than zero from shoulder 14, so as to form an annular chamber 29 defined by shoulders 14 and 27 and by facing portions of faces 12 and 24.

Valve body 17 has a hole 30 and nozzle for connecting annular chamber 29 to seat 9; and a hole 31 and nozzle for connecting seat 9 to seat 23 housing shutter 19.

Injector 1 also comprises a seal 32 extending between face 12 and face 24 and adjacent to shoulder 14 to prevent fuel leaking from annular chamber 29 between face 11 of injector body 2 and face 24 of valve body 17.

Figure 2:
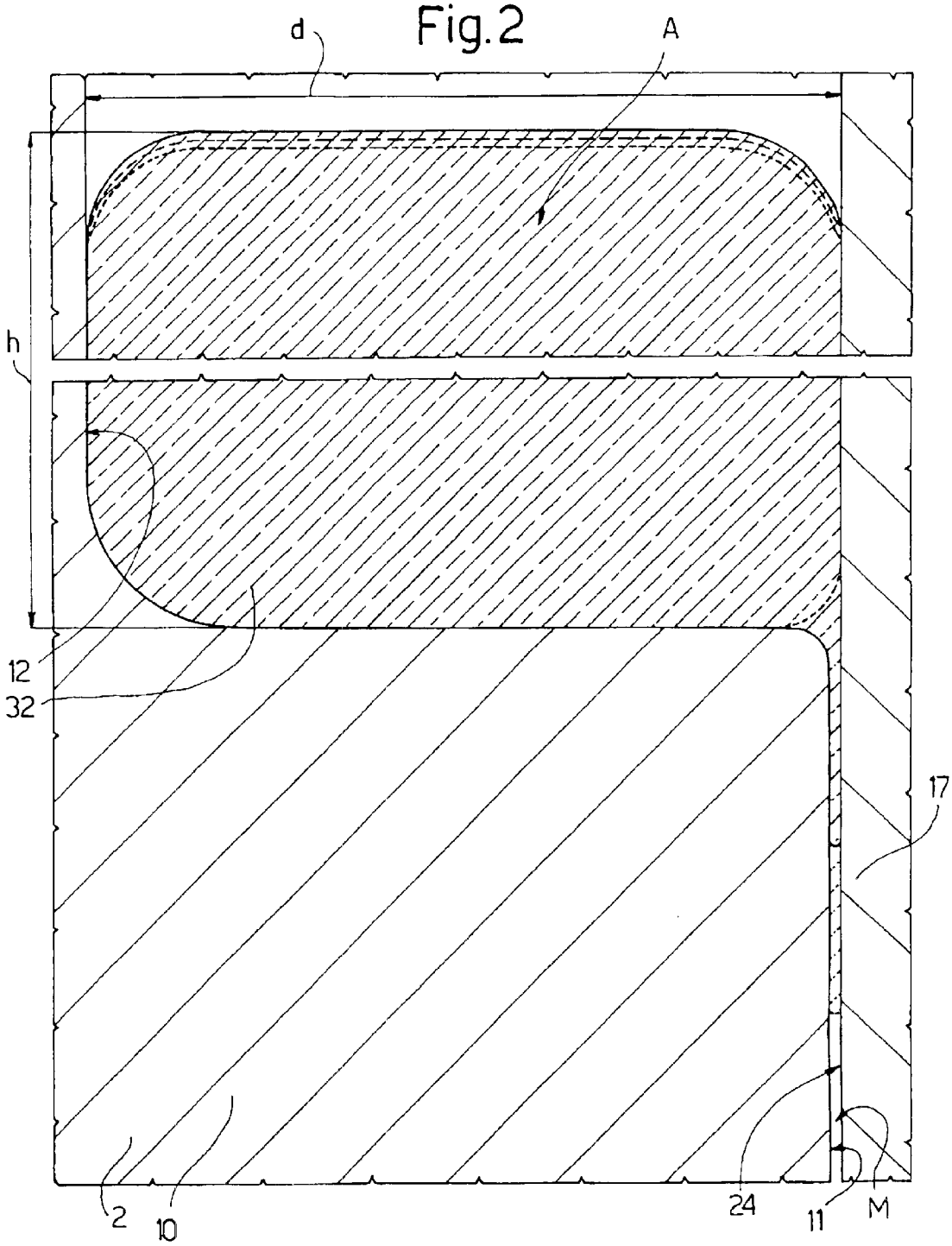
FIG. 2 shows a larger-scale section of a detail in FIG. 1.

With reference to FIG. 2, face 24 of valve body 17 and face 11 of injector body 2 are separated by an annular gap M, which depends on the precision of the machines used to produce the component parts of injector 1, and which, at worst, is defined by a radial clearance of 0.02 mm.

Research by the Applicant has shown the working life of injector 1 to depend on the extent to which seal 32 is drawn along gap M. That is, seal 32 is deformed permanently and fills gap M between faces 11 and 24, as shown in FIGS. 1 and 2, so that material is withdrawn at face 24, thus resulting in rapid wear of seal 32.

Seal 32 is made of PTFE, i.e. Teflon enriched with bronze particles, or of a material known commercially as TURCON®.

Research by the Applicant has shown the life LF of injector 1 to depend on (be proportional ∞ to) the life LF' of seal 32 according to the following equation:

$$LF' \infty LF = K \cdot \frac{A \cdot \left(\frac{h}{d}\right)^2}{P \cdot T \cdot M}$$

where:

K is a correction coefficient of the measuring units;

h is the height of seal 32 measured parallel to axis 3;

d is the width of seal 32, substantially corresponding to the difference between the diameters of cylindrical faces 12 and 24;

A is the section of the seal, substantially equal to h×d;

P is the maximum operating pressure in chamber 29;

T is the maximum operating temperature in chamber 29;

M is the size of annular gap M.

In other words, the life LF of injector 1 depends on the life of seal 32, and in particular on the permanent deformation to which seal 32 is subjected.

Currently used injectors have a maximum operating pressure P of 1500 bars, and a maximum operating temperature T of 180° C.

The other quantities on which the life LF of injector 1 depends are dimensional quantities of valve body 17, of injector body 2, and of seal 32, the size of which depends on the size of annular chamber 29. More specifically, as will be clear from the equation, to extend the working life of the injector, a high, narrow chamber 29 is preferable to increase the h/d ratio. The size of annular chamber 29, however, depends on other design parameters, such as the width d of annular chamber 29, which corresponds to the width d of seal 32. Research by the Applicant has shown an h/d ratio of 1 to 2 gives good life LF values and enables adequate sizing of annular chamber 29, and that h/d ratios of 1.5 to 2 are in all cases preferable.

In general, the research conducted by the Applicant, which led to the discovery of the major cause of the reduction in the life of injector 1 and of the above equation, provides for establishing a uniform life LF of injectors 1 and, at the same time, a life LF which conforms with that of the internal combustion engines on which injectors 1 are installed.

Since life LF depends on the life of engine E, the following equation applies:

$$h = \sqrt[2]{\frac{LF \cdot P \cdot T \cdot M \cdot d^2}{K \cdot A}}.$$

In the case of seal 32, in which A substantially equals h×d, this gives $$h = \sqrt[3]{\frac{LF \cdot P \cdot T \cdot M \cdot d}{K}},$$

which gives the height h of seal 32, i.e. the only design parameter for determining life LF which is not affected by other characteristics of injector 1.

In accordance with the object of the present invention, life LF is predetermined; the maximum operating pressure P has a given value of 1500 bars, as does the maximum operating temperature T, which equals 180° C.; the size of gap M is defined by the type of machining to form seat 5 of injector body 2 and valve body 17; and the width d of annular chamber 29 is determined according to the required hydraulic function of chamber 29. The size of gap M also depends on the mean diameter of gap M and therefore on the size of injector 1.

What is claimed is:

1. A method of producing fuel injectors for internal combustion engines, each injector (1) comprising an injector body (2) having a seat (5); a valve body (17) housed inside said seat (5) so as to form an annular chamber (29), for receiving high-pressure fuel, and a gap (M) communicating with said annular chamber (29); and a seal (32) for sealing said gap (M); the method being characterized by sizing said seal (32) as a function of the deformation to which said seal (32) is subjected during use of said injector (1), so as to achieve a predetermined working life (LF) of said injector (1).

2. A method as claimed in claim 1, characterized by sizing said seal (32) as a function of the permanent deformation to which said seal (32) is subjected during use of said injector (1).

3. A method as claimed in claim 1, characterized by sizing said seal (32) as a function of the size of said gap (M); the size of the seal (32) being inversely proportional to the size of said gap (M).

4. A method as claimed in claim 1, characterized in that said seal (32) is annular and has a height (h) and a width (d); said width being equal to the width of said annular chamber (29).

5. A method as claimed in claim 4, characterized by determining the height (h) of said seal as a function of a predetermined life (LF) of said injector (1).

6. A method as claimed in claim 5, characterized by determining the height (h) of said seal (32) as a function of the maximum operating pressure (P) and maximum operating temperature (T) of said injector (1).

7. A method as claimed in claim 4, characterized by determining the height (h) of the seal (32) according to the equation:

$$h = \sqrt[3]{\frac{LF \cdot P \cdot T \cdot M \cdot d}{K}}.$$

8. A method as claimed in claim 1, characterized in that said seal (32) is made of Teflon enriched with bronze particles.

9. A method as claimed in claim 1, characterized in that said seal is made of TURCON®.

10. A method as claimed in claim 1, characterized by predetermining the working life (LF) of the injector (1) equal to the working life of the internal combustion engine (E) on which said injector (1) is installed.

11. A fuel injector for an internal combustion engine (E), the injector comprising an injector body (2) having a seat (5); a valve body (17) housed inside said seat (5) so as to form an annular chamber (29), for receiving high-pressure fuel, and a gap (M) communicating with said annular chamber (29); and a seal (32) for sealing said gap (M); the injector being characterized in that said seal (32) is sized as a function of the deformation to which said seal (32) is subjected during use of said injector (1), so as to obtain a predetermined working life (LF) of said injector (1).

12. An injector as claimed in claim 11, characterized in that said seal (32) is sized as a function of the size of said gap (M); the size of the seal (32) being inversely proportional to the size of said gap (M).

13. An injector as claimed in claim 11, characterized in that said seal (32) is annular and has a height (h) and a width (d) measured radially; said width (d) being equal to the width of said annular chamber (29).

14. An injector as claimed in claim 13, characterized by determining the height (h) of said seal (32) as a function of a predetermined life (LF) of said injector (1).

15. An injector as claimed in claim 14, characterized by determining the height (h) of said seal (32) as a function of the maximum operating pressure (P) and maximum operating temperature (T) of said injector (1).

16. An injector as claimed in claim 13, characterized by determining the height (h) of the seal (32) according to the equation:

$$h = \sqrt[3]{\frac{LF \cdot P \cdot T \cdot M \cdot d}{K}}.$$

17. An injector as claimed in claim 11, characterized in that said seal (32) is made of Teflon enriched with bronze particles.

18. An injector as claimed in claim 11, characterized in that said seal is made of TURCON®.

* * * * *